United States Patent [19]

Dressler et al.

[11] Patent Number: 4,604,491

[45] Date of Patent: Aug. 5, 1986

[54] SYNTHETIC OILS

[75] Inventors: Hans Dressler, Monroeville, Pa.; Albert A. Meilus, Parma, Ohio

[73] Assignee: Koppers Company, Inc., Pittsburgh, Pa.

[21] Appl. No.: 674,881

[22] Filed: Nov. 26, 1984

[51] Int. Cl.[4] ..... C07C 13/47; C07C 15/20

[52] U.S. Cl. ..... 585/26; 585/7; 585/25; 585/455

[58] Field of Search ..... 585/25, 26, 7, 455

[56] References Cited

U.S. PATENT DOCUMENTS

| | | | |
|---|---|---|---|
| 2,626,242 | 1/1953 | Talley et al. | 585/26 |
| 2,866,142 | 12/1958 | Cook et al. | 585/26 |

FOREIGN PATENT DOCUMENTS

| | | | |
|---|---|---|---|
| 323100 | 12/1929 | United Kingdom | 585/26 |
| 544644 | 8/1974 | U.S.S.R. | 585/26 |
| 806667 | 2/1981 | U.S.S.R. | 585/26 |

*Primary Examiner*—Andrew H. Metz
*Assistant Examiner*—A. Pal
*Attorney, Agent, or Firm*—Donald M. MacKay; Herbert J. Zeb, Jr.

[57] ABSTRACT

Synthetic base oils for functional fluids and greases are provided comprising a mixture of monoalkylated naphthalenes and polyalkylated naphthalenes, said naphthalenes represented by the formula:

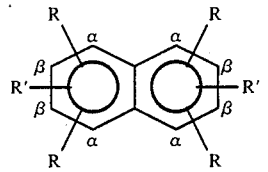

wherein the R′ groups are independently selected from H and methyl, the monoalkylated naphthalenes have three R groups which are H and one R group which is a 12–26 carbon alkyl, the polyalkylated naphthalenes have from two to four R groups which are 12–26 carbon alkyl and any remainder R groups H, and the weight ratio of monoalkylated naphthalenes to polyalkylated naphthalenes is from 5:95 to 70:30 when the average alkyl group is $C_{12}$–$C_{16}$ and from 5:95 to 99:1 when the average alkyl group is $C_{17}$–$C_{26}$. In the preferred mixture, the polyalkylated naphthalenes have a numerical ratio of $\alpha/\beta$ substitution of from 50/50 to 10/90 when the R′ groups are both H.

21 Claims, No Drawings

SYNTHETIC OILS

BACKGROUND OF THE INVENTION

There is a continuous need for synthetic oils such as lubricants and base stocks for greases of moderate cost with a combination of low volatility at high temperatures (>200° C.), high flash points (>260° C./500° F.), high fire points (>530° F.), excellent viscosity indices (≧100), good pour points (as low as −40° F.), good lubricity and good response to additives.

A group of synthetic oils have now been discovered that fulfills all or most of the above requirements.

BRIEF DESCRIPTION OF THE INVENTION

Synthetic oils have been discovered comprising a mixture of monoalkylated naphthalenes and polyalkylated naphthalenes, said naphthalenes represented by the formula:

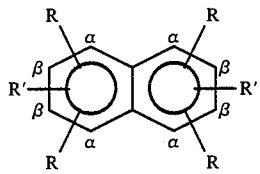

wherein the R′ groups are independently selected from H and methyl, the monoalkylated naphthalenes have three R groups which are H and one R group which is a 12–26 carbon alkyl, the polyalkylated naphthalenes have from two to four R groups which are 12–26 carbon alkyl and any remainder R groups H, and the weight ratio of monoalkylated naphthalenes to polyalkylated naphthalenes is from 5:95 to 70:30 when the average alkyl group is $C_{12}$–$C_{16}$ and from 5:95 to 99:1 when the average alkyl group is $C_{17}$–$C_{26}$. In the preferred mixture, the polyalkylated naphthalenes have a numerical ratio of $\alpha/\beta$ substitution of from 50/50 to 10/90 when the R′ groups are both H.

Thus, the mixture comprises naphthalenes, methyl naphthalenes and dimethyl naphthalenes and their mixtures alkylated with $C_{12}$ to $C_{26}$ alkyl groups.

DETAILED DESCRIPTION OF THE INVENTION

In formulating the synthetic oils of the invention, the amount of monoalkylated naphthalene employed in the oil will depend upon the use contemplated for the oil, the particular olefins employed, whether a single olefin or a mixture of olefins is employed to make the polyalkylated naphthalene, and whether a single or mixture of monoalkylated naphthalenes is employed.

Generally, however, the ratio of monoalkylated naphthalene to polyalkylated naphthalene should be from 5:95 to 70:30 by weight, preferably from 5 to 30% monoalkylnaphthalene when the monoalkylated and the polyalkylated alkyl groups are $C_{12}$ to $C_{16}$ and 15 to 99% monoalkylnaphthalene when said alkyl groups are greater than $C_{16}$.

The synthetic oils are manufactured by reacting naphthalene with an α-olefin (to include mixtures) in a molar ratio of from 1 naphthalene:0.8 olefin to 1 naphthalene:5 olefin at elevated temperatures between about 150° C. and about 260° C. for a time between about 0.25 hrs. and about 6 hrs. in the presence of a catalyst. The ratio of monoalkylated naphthalene to polyalkylated naphthalene can be varied by adjusting the mole ratio of reactants. For example, if it is desired to prepare mixtures high in monoalkylated naphthalene of 50% or more by weight then a mole ratio of naphthalene to olefin of about 1:1 is employed. If it is desired to prepare dialkylated naphthalenes, a mole ratio of naphthalene to olefin of about 1:2.2 is employed. For trialkylated naphthalenes, a mole ratio of naphthalene to olefin of about 1:4 is employed, and a ratio of 1:5 naphthalene to olefin is employed for tetraalkylated naphthalenes. An inert diluent, such as an aliphatic hydrocarbon, may be used. Suitable catalysts include the activated clay alumina silicates and high silica zeolites which are used in an amount from between about 10 wt.% and about 100 wt.% based on the naphthalene. The products are essentially free of unsaturated by-products which would increase their susceptibility to oxidation. The synthetic base oils can be used for making lubricants, hydraulic fluids, vacuum pump oils, heat transfer fluids, and other functional fluids and lithium, aluminum, bentonite and urea complex greases.

The invention will be illustrated in more detail in the following examples. All parts and percentages in said examples and elsewhere in the specification and claims are by weight unless otherwise specified.

EXAMPLE 1

A 1-l glass reactor was charged with 130.0 g. (1.02 m) of naphthalene, 564.0 g. (2.25 m) of Chevron Chemical Co. $C_{15-20}$α-olefin, which consists of 1% $C_{14}$, 17% $C_{15}$, 18% $C_{16}$, 17% $C_{17}$, 17% $C_{18}$, 15% $C_{19}$, 12% $C_{20}$, and 3% $C_{21}$ olefin, and 70.0 g. of Filtrol-13 acid activated silica alumina clay (low moisture catalyst). The charge was agitated and heated to 200° C., held at this temperature for six hours, then allowed to cool to room temperature (25° C.) and discharged. The resultant slurry was filtered and the filtrate was distilled to a pot temperature of 260° C. at 1 torr to provide 456.7 g. (65.8% yield on the organics charged; 79.5% yield corrected for losses, mostly holdup in the filter cake) of a residual product as a light amber oil. By IR/NMR ($^1H$ and $^{13}C$) analysis this residue consisted of 73% of polyalkyl($C_{15}$–$C_{20}$) substituted naphthalenes with about 80% beta substitution and 27% monoalkylated naphthalenes (determined by IR/NMR and GC analysis).

The product had a viscosity of 84 SUS at 210° F., flash point 520° F. (ASTM D92), viscosity index 110, and pour point −5° F. (ASTM D97).

EXAMPLE 2

A 2-l glass reactor was charged with 130.0 g (1.02 m) of naphthalene, 504.0 g. (2.25 m) of hexadecene-1 (Shell Chemical's Neodene-16), and 70.0 g. of Filtrol-13. The mixture was agitated and reacted at 200° C. for 6 hrs., then allowed to cool to room temperature (25° C.) and filtered. The filtrate was distilled to a pot temperature of 260° C. at 1 torr to provide 490.7 g (77.4% yield based on the organics charged; 86.8% yield corrected for losses) of a gold-colored oil. The product was identified by IR/NMR analysis as a naphthalene having an average of two $C_{16}$-alkyl substituents with 34/66 ratio of α- to β substitution, and containing 24% of $C_{16}$-monosubstituted naphthalene. No olefinic double bond was detectable in this oil. The oil had a flash point of 515° F.; a fire point of 575° F.; a pour point of −30° F.; a viscosity of 545 SUS and 69.8 SUS at 100° F. and 210° F., respectively, and a viscosity index of 110.

To test for lubricity, the products of Examples 1 and 2 were compared with a commercial mineral oil and two synthetic ester oils in industrial lubricant evaluation tests according to ASTM D2596 and D2266. The results are shown in the following Table I.

TABLE I

| | Products of Ex. 1 | Products of Ex. 2. | Sohio 600[1] | HUMKO 3681[2] | SYNLUBE 500[3] | TMPTH[4] |
|---|---|---|---|---|---|---|
| Four-Ball EP | | | | | | |
| Load Wear Index, Kg | | 21.09 | 19.96 | | | |
| Weld, Kg | | 126.0 | 80.0 | | | |
| Four-Ball Wear Scar, mm at 20 Kg 1800 rpm, 130° F., 1 hr. | | 0.27 | 0.30 | | | |
| Oxidation Stability Test (neat oil) % Evaporation at 400° F. | | | | | | |
| after 24 hrs. | 22.9 | 23.0 | 34.3 | 82.2 | 87.8 | Solid |
| after 48 hrs. | 29.8 | 29.3 | | | | |
| after 72 hrs. | 32.6 | 31.6 | | | | |
| after 96 hrs. | Solid | 35.4 | | | | |
| Hours to Solidification at 400° F. | 96 | 103 | 48 | 24 | 24 | 24 |
| Viscosity, SUS | | | | | | |
| 100° F. | | 546 | 600 | | 87 | |
| 210° F. | | 70 | 69 | 66 | 40 | |
| % Sludge (Hexane) Insolubles after # Hrs. at 400° F. | — | 18 | — | — | — | 51.0 |
| Flash Point (COC), °F. | — | 515 | 515 | — | 490 | 460 |

[1]product of Standard Oil Company of Ohio
[2]product of Humko Chemical Company
[3]product of Synlube International Co.
[4]trimethylolpropane tri-n-heptanoate, Product of Stauffer Chemical Co.
From the results, it can be seen that the products of the invention compare favorably with or are better than the commercial products.

Other useful synthetic oils and their properties are shown in the attached Table II. The alkylated naphthalenes were prepared in a manner similar to Examples 1 and 2.

In the following Table III base oils of the invention are compared with commercial oils. The base oils of Examples 24–34 were made in accordance with the general procedure of Examples 1 and 2. The resultant products had a weight ratio of monoalkylated naphthalene to polyalkylated naphthalene within the claimed range and the polyalkylated naphthalenes had a numerical ratio of $\alpha/\beta$ substitution within the preferred range. The olefins employed are listed by carbon number, or carbon number range for mixed olefins, in the table.

TABLE II

| Catalyst (gm) | Reactant[a] Quantities | Reaction Temp/Time °C. | Reaction Temp/Time hr. | Ex. No | Olefin[b] | Product: Number Alkyl Grps. | Product: Ratio α-β Substit. | Product: % Mono alkylate | Flash pt., °F. | Pour pt., °F. | Viscosity, SUS 100° F. | Viscosity, SUS 210° F. | V.I. |
|---|---|---|---|---|---|---|---|---|---|---|---|---|---|
| ALKYNAPHTHALENES-STRUCTURE VS. PROPERTIES | | | | | | | | | | | | | |
| 70.0 Filtrol 13 | 1.0mN;4.0mC$_{14}$ | 150 | 5.5 | 3 | C$_{14}$S | 3.0 | 43:57 | 10 | 512 | — | 39 | 62 | 113 |
| 57.0 Filtrol 13 | 0.5mN;2.5mC$_{14}$ | 200 | 4 | 4 | C$_{14}$S | 3.6 | 36:64 | 12 | 525 | −40 | 700 | 79 | 109 |
| 65.0 Filtrol 13 | 2.0mN;2.0mC$_{18}$ | 220 | 1 | 5 | C$_{18}$S | 1.5 | 5:95 | 50 | 508 | +5 | 389 | 61 | 114 |
| 60.0 Filtrol 13 | 0.42mN;2.25mC$_{18}$ | 200 | 4 | 6 | C$_{18}$S | 2.8 | 20:80 | — | 535 | — | 460 | 69 | 118 |
| 70.0 Filtrol 13 | 1.0mN;2.25mC$_{16}$ | 200 | 6 | 7 | C$_{16}$G | 2.0 | 34:66 | 24 | 515 | −30 | 525 | 68 | 110 |
| 3.56 lb. Filtrol 13 | 6.6 lb.N;25.6 lb.C$_{16}$ | 175 | 6 | 8 | C$_{16}$S | 2.1 | 54:46 | 20 | 520 | −5 | 571 | 72 | 111 |
| 100 Filtrol 13 | 0.8mN;4.0C$_{16}$ | 175 | 5 | 9 | C$_{16}$S | 3.0 | 39:61 | 16 | 535 | — | 560 | 75 | 120 |
| 70.0 Filtrol 13 | 1.0mN;3.5mC$_{12-14}$ | 175 | 6 | 10 | C$_{12-14}$E | 3.0 | — | — | 520 | — | 480 | 65 | 106 |
| 78 Filtrol 13 | 0.9mN;2.1mC$_{12-14}$ | 200 | 4 | 11 | C$_{12-26}$E | 2.4 | 33:67 | — | 560 | +5 | 791 | 84 | 117 |
| 70 Filtrol 13 | 1.0mN;2.5mC$_{14-16}$ | 200 | 4 | 12 | C$_{14-16}$S | 2.3 | — | 17 | 545 | — | 525 | 69 | 109 |
| 56 Filtrol 13 | 2.0mN;4.4mC$_{14-16}$ | 220 | 1 | 13 | C$_{14-16}$S | — | — | 17 | 520 | — | 562 | 88 | 136 |
| 70 Filtrol 13 | 1.0mN;2.5mC$_{14-18}$ | 200 | 4 | 14 | C$_{14-18}$S | 2.4 | 24:76 | — | 545 | — | 580 | 77 | 112 |
| 52 Filtrol 13 | 1.0mN;2.2mC$_{14-18}$ | 220 | 3 | 15 | C$_{14-18}$E | 2.0 | 12:88 | 24 | 520 | — | 510 | 69 | 105 |
| 56 Filtrol 13 | 2.0mN;4.5mC$_{14-18}$ | 220 | 1 | 16 | C$_{14-18}$S | — | — | 17 | 545 | — | 585 | 74 | 114 |
| 280 Filtrol 13 | 3.5mN;7.9mC$_{15-20}$ | 200 | 4 | 17 | C$_{15-20}$C | 2.0 | 37:63 | 26 | 533 | — | 640 | 77 | 110 |
| 45 Filtrol 13 | 0.5mN;1.6mC$_{16-18}$ | 175 | 6 | 18 | C$_{16-18}$E | 2.2 | 50:50 | 26 | 530 | — | 510 | 72 | 114 |
| 75 Filtrol 13 | 1.0mN;3.0mC$_{18-20}$ | 200 | 4 | 19 | C$_{18-20}$E | 2.0 | 40:60 | 22 | 540 | — | 590 | 77 | 117 |
| 78 Filtrol 13 | 1.0mN;2.2mC$_{20-24}$ | 200 | 4 | 20 | C$_{20-24}$G | 2.1 | 37:63 | — | 550 | — | 625 | 80 | 116 |
| COMPARISON OILS | | | | | | | | | | | | | |
| 36 Filtrol 13 | 0.8mN;3.2mC$_8$ | 200 | 3 | 21 | C$_8$F | 2.9 | 30:70 | — | 485 | — | 200 | 74 | 69 |
| | | 220 | 1 | | | | | | | | | | |
| 45 Filtrol 24 | 1.0mN;2.2mC$_{10}$ | 200 | 4 | 22 | C$_{10}$G | 2.2 | 23:77 | 5.3 | 485 | — | 550 | 60 | 78 |
| 65 Filtrol 13 | 2.0mN;2.0mC$_{16}$ | 220 | 0.5 | 23 | C$_{16}$G | 1.1 | 12:88 | 100* | 453 | — | 140 | 45 | 136 |

[a]N = naphthalene;
[b]S = Shell Oil Corp.; G = Gulf Oil Corp.; E = Ethyl Corp.; F = Fisher Scientific Corp.; and C = Chevron Corp.
* = Distilled to obtain monoalkylate

TABLE III

COMPARATIVE EVALUATION OF ALKYLNAPHTHALENES OF THE INVENTION WITH COMMERCIAL OILS

| Product Identification | Sohio 600 Mineral Oil | Monsanto OS-124 Poly (phenyl ether) | Stauffer TMPTH Triol triester |
|---|---|---|---|
| Flash pt., °F. | 450 | 550 | 460 |
| Pour pt., °F. | −8 | +40 | −90 |
| Viscosity,SUS, 100° F. | | 1682 | 77.0 |
| Viscosity,SUS, 210° F. | | 70.2 | 37.5 |
| Viscosity Index | | −70 | |
| Evaporation loss, wt. %, 400° F., 24 hrs. | 23.2 | 5.3 | 92.7 |
| Evaporation loss, wt. %, 400° F., 48 hrs. | | 14.3 | |
| Evaporation loss, wt. %, 400° F., 72 hrs. | | 23.1 | |
| Evaporation loss, wt. %, 400° F., 96 hrs. | | 30.0 | |
| Evaporation loss, wt. %, 400° F., 103 hrs. | | 31.5 | |
| Evaporation loss, wt. %, 400° F., 127 hrs. | | | |
| Hours to solidify | 48 | 200+ | 24 |
| Sludge, wt. % at 103 hrs. | | 1.1 | |
| Sludge, wt. % at 150 hrs. | | 10.4 | |

| Product Identification | NASA Mil. Spec. 23699 Oil Fully formulated polyolester | | Humko 3681 Ester | Synlube 500 Di-ester | Synlube 501 Di-ester |
|---|---|---|---|---|---|
| Flash pt., °F. | | | 490 | 490 | 490 |
| Pour pt., °F. | −90 | | | −36 | −70 |
| Viscosity,SUS, 100° F. | 78.2 | | | 86.5 | 80 |
| Viscosity,SUS, 210° F. | 37.8 | | 66 | 39.5 | 38 |
| Viscosity Index | 125 | | | 177 | 154 |
| Evaporation loss, wt. %, 400° F., 24 hrs. | 100 | | 82.2 | 87.8 | 91.0 |
| Evaporation loss, wt. %, 400° F., 48 hrs. | | | | | |
| Evaporation loss, wt. %, 400° F., 72 hrs. | | | | | |
| Evaporation loss, wt. %, 400° F., 96 hrs. | | | | | |
| Evaporation loss, wt. %, 400° F., 103 hrs. | | | | | |
| Evaporation loss, wt. %, 400° F., 127 hrs. | | | | | |
| Hours to solidify | 24 | 24 | 24 | 24 | 72 |
| Sludge, wt. % at 103 hrs. | | 51(24 hrs.) | | | |
| Sludge, wt. % at 150 hrs. | | | | | |

| Example Identification | 24 $2.8C_{12-}$ | 25 $3.6C_{14-}$ | 26 $3.0C_{14-}$ | 27 $2.2C_{16-}$ | 28 $2.0C_{16-}$ | 29 $3.0C_{16-}$ |
|---|---|---|---|---|---|---|
| Flash Pt., °F. | 535 | 525 | 525 | 525 | 515 | 535 |
| Pour pt., °F. | −40 | −40 | −40 | −5 | −30 | 0 |
| Viscosity,SUS, 100° F. | 849 | 699 | 668 | 571 | 546 | 560 |
| Viscosity,SUS, 210° F. | 84.0 | 79.3 | 77.7 | 71.8 | 69.8 | 74.6 |
| Viscosity Index | 102 | 110 | 95 | 111 | 110 | 119 |
| Evaporation loss, wt. %, 400° F., 24 hrs. | 13.8 | 16.2 | 16.5 | 18.3 | 23.0 | 14.1 |
| Evaporation loss, wt. %, 400° F., 48 hrs. | 29.8 | 21.4 | 26.5 | 25.2 | 29.3 | 19.5 |
| Evaporation loss, wt. %, 400° F., 72 hrs. | 40.3 | 26.8 | | 29.9 | 31.6 | 24.9 |
| Evaporation loss, wt. %, 400° F., 96 hrs. | 45.9 | 31.0 | | 33.8 | 35.4 | 28.6 |
| Evaporation loss, wt. %, 400° F., 103 hrs. | | 32.0 | | 34.5 | | 28.7 |
| Evaporation loss, wt. %, 400° F., 127 hrs. | | | | | | 32.1 |
| Hours to Solidify | 96 | | 72 | 103 | 103 | |
| Sludge, wt. % at 103 hrs. | | 4.2 | | 4.0 | | 41.1** |
| Sludge, wt. % at 150 hrs. | | 24.5 | | 2.7* | | |

| Example Identification | 30 $2.0C_{18-}$ | 31 $2.4C_{12-26}$ | 32 $2.1C_{14-26}$ | 33 $C_{14-28}$ | 34 $C_{15-20}$ |
|---|---|---|---|---|---|
| Flash Pt., °F. | 525 | 560 | 570 | 520 | |
| Pour pt., °F. | 0 | +5 | +10 | wax | −5 |
| Viscosity,SUS, 100° F. | 603 | 791 | 750 | — | 700 |
| Viscosity,SUS, 210° F. | 75.3 | 84.3 | 82.9 | 89.1 | 83.5 |
| Viscosity Index | 114 | 117 | 111 | — | 110 |
| Evaporation loss, wt. %, 400° F., 24 hrs. | 17.1 | 9.9 | 10.4 | 11.2 | 27.7 |
| Evaporation loss, wt. %, 400° F., 48 hrs. | 24.2 | 15.0 | 15.8 | 14.8 | 33.1 |
| Evaporation loss, wt. %, 400° F., 72 hrs. | 29.2 | 20.8 | 20.3 | 18.5 | 46.2 |
| Evaporation loss, wt. %, 400° F., 96 hrs. | 32.5 | 24.9 | 24.1 | 21.4 | 50.2 |
| Evaporation loss, wt. %, 400° F., 103 hrs. | 26.0 | 25.4 | 21.7 | | |
| Evaporation loss, wt. %, 400° F., 127 hrs. | 30.2 | 29.2 | | | |
| Hours to Solidify | 103 | 127 | 127 | 103 | 96 |
| Sludge, wt. % at 103 hrs. | 23.2** | 55.6** | 2.4 | 26.5*** | |
| Sludge, wt. % at 150 hrs. | | | | | |

| Example Introduction | 35 $2.0C_{15-20}$ | 36 $1.8C_{15-20}$ | 37 $2.0C_{15-20}$ | 38 $1.7C_{18-24}$ | 39 $2C_{24-28}$ |
|---|---|---|---|---|---|
| Flash pt., °F. | 505 | 515 | 540 | 550 | 545 |
| Pour pt., °F. | 0 | | +25 | +10 | wax |
| Viscosity,SUS, 100° F., | 698 | 588 | 644 | 692 | — |
| Viscosity Index | 79.0 | 71.5 | 79.0 | 80.2 | 91.0 |
| Evaporation loss, wt. %, 400° F., 24 hrs. | 109 | 107 | 116 | 113 | — |
| Evaporation loss, wt. %, 400° F., 48 hrs. | 22.9 | 29.9 | 15.5 | 15.3 | 9.0 |
| Evaporation loss, wt. %, 400° F., 72 hrs. | 29.8 | 36.9 | 22.9 | 23.9 | 13.0 |
| Evaporation loss, wt. %, 400° F., 96 hrs. | 32.6 | 43.8 | 26.0 | 30.9 | 17.6 |

TABLE III-continued

COMPARATIVE EVALUATION OF ALKYLNAPHTHALENES OF THE INVENTION WITH COMMERCIAL OILS

| | | | | | |
|---|---|---|---|---|---|
| Evaporation loss, wt. %, 400° F., 103 hrs. | | 48.3 | 29.2 | 32.9 | 21.0 |
| Evaporation loss, wt. %, 400° F., 127 hrs. | | | | 33.6 | 21.6 |
| Hours to Solidify | 96 | 96 | 103 | 103 | 103 |
| Sludge, wt. % at 103 hrs. | | | | | |
| Sludge, wt. % t 150 hrs. | | | 25.0*** | 4.5 | 15.2 |

*Added 1 wt. % phosphite of 4, 6-di-t-butylresorcinol
**% Sludge at 127 hrs.
***% Sludge at 96 hrs.

The following grease formulations (components in parts) are illustrative of the use of the synthetic oils of the invention.

GREASES

| | 40 | 41 | 42 | 43 | 44 | Commercial Bentone Grease with Mineral Oil |
|---|---|---|---|---|---|---|
| Bentone Clay[1] | 6.4 | 8.8 | | | 6.4 | 6.4 |
| Polyalkylated Naphthalene[2] | 92.2 | 88.8 | 84.1 | 83.2 | | |
| Oxidation Inhibitor[3] | | 1.0 | 1.0 | | | |
| Stearic Acid | | | 5.2 | 6.7 | | |
| Azelaic Acid | | | 5.1 | | | |
| Benzoic Acid | | | | 2.9 | | |
| Mineral Oil | | | | | | 92.2 |
| Anti Wear Vanlube 71[4] | | | | 2.0 | | |
| Acetone & $H_2O$ | 1.4 | 1.4 | | | 1.4 | 1.4 |
| Aluminum Hydrate | | | | 5.2 | | |
| Alpha-olefine polymer[5] | | | | | 92.2 | |
| Lithium Hydroxide | | | 4.6 | | | |
| ASTM D1263-61 modified at 305° F. in hours-Bearing Life | 308 | 493 | 409 | 576 | 168 | 103 |

[1]Product of National Lead Co.
[2]2-$C_{16}$alkyl groups & 20% $C_{16}$mono-alkyl; pour point −5° F., Flash pt. 525° F.;$\alpha/\beta$ substitution 54/46
[3]Tris(4,6-di-t-butyl-3-hydroxyphenyl) phosphite
[4]Product of R. T. Vanderbilt Co.
[5]A 6 cSt synfluid of Gulf Chemical Co.

From the above, it can be seen that the compositions of the invention have a number of useful properties. Obvious modifications may be apparent to one or ordinary skill, however, and thus the invention is intended to be limited only by the appended claims.

What is claimed is:

1. A synthetic base oil for functional fluids and greases comprising a mixture of monoalkylated naphthalenes and polyalkylated naphthalenes, said naphthalenes represented by the formula:

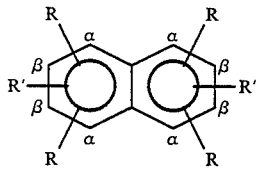

wherein the R' groups are independently selected from H and methyl, the monoalkylated naphthalenes have three R groups which are H and one R group which is a 12–26 carbon alkyl, the polyalkylated naphthalenes have from two to four R groups which are 12–26 carbon alkyl and any remainder groups H, the weight ratio of monoalkylated naphthalenes to polyalkylated naphthalenes is from 5:95 to 70:30 when the average alkyl group is $C_{12}$–$C_{16}$ and from 5:95 to 99:1 when the average alkyl group is $C_{17}$–$C_{26}$ and the oil has a viscosity at 210° F. between 61 and 88 SUS, a viscosity index between 105 and 136, and a flash point (COC=Cleveland open cup) of between 508° F. and 560° F.

2. The base oil of claim 1 wherein a mixture of different polyalkylated naphthalenes is employed.

3. The base oil of claim 1 wherein a mixture of different monoalkylated naphthalenes is employed.

4. The base oil of claim 1 wherein the ratio of monoalkylated naphthalene to polyalkylated naphthalene is from 5:95 to 30:70 and the alkyl groups are $C_{12}$ to $C_{16}$.

5. The base oil of claim 1 wherein the ratio of monoalkylated naphthalene to polyalkylated naphthalene is from 15:85 to 99:1 when the alkyl groups are $C_{17}$ to $C_{26}$.

6. The base oil of claim 1 wherein the polyalkylated naphthalene has an average of two 16-carbon alkyl groups.

7. The base oil of claim 1 wherein the polyalkylated naphthalene has an average of three 14-carbon alkyl groups.

8. The base oil of claim 1 wherein the polyalkylated naphthalene has an average of 3.6 14-carbon alkyl groups.

9. The base oil of claim 1 wherein the polyalkylated naphthalene has an average of 1.5 18-carbon alkyl groups.

10. The base oil of claim 1 wherein the polyalkylated naphthalene has an average of 2.8 18-carbon alkyl groups.

11. The base oil of claim 1 wherein the polyalkylated naphthalene has an average of 2.0 16-carbon alkyl groups.

12. The base oil of claim 1 wherein the polyalkylated naphthalene has an average of 2.1 16-carbon alkyl groups.

13. The base oil of claim 1 wherein the polyalkylated napthalene has an average of 3.0 alkyl groups with 12–14 carbon atoms each.

14. The base oil of claim 1 wherein the polyalkylated naphthalene has an average of 2.4 alkyl groups with 12–26 carbon atoms each.

15. The base oil of claim 1 wherein the polyalkylated naphthalene has an average of 2.3 alkyl groups with 14–16 carbon atoms each.

16. The base oil of claim 1 wherein the polyalkylated naphthalene has an average of 2.4 alkyl groups with 14–18 carbon atoms each.

17. The base oil of claim 1 wherein the polyalkylated naphthalene has an average of 2.0 alkyl groups with 14–18 carbon atoms each.

18. The base oil of claim 1 wherein the polyalkylated naphthalene has an average of 2.0 alkyl groups 15–20 carbon atoms each.

19. The base oil of claim 1 wherein the polyalkylated naphthalene has an average of 2.2 alkyl groups with 16–18 carbon atoms each.

20. The base oil of claim 1 wherein the polyalkylated naphthalene has an average of 2.0 alkyl groups with 18–20 carbon atoms each.

21. The base oil of claim 1 wherein the polyalkylated naphthalenes have a numerical ratio of $\alpha/\beta$ substitution of from 50/50 to 10/90 and the R′ groups are both H.

* * * * *